United States Patent [19]

Takashima

[11] Patent Number: 5,048,472

[45] Date of Patent: Sep. 17, 1991

[54] TWO STROKE CYCLE INTERNAL COMBUSTION ENGINE

[76] Inventor: Jiro Takashima, 7203 Schiller, Houston, Tex. 77055

[21] Appl. No.: 562,881

[22] Filed: Aug. 3, 1990

[51] Int. Cl.[5] ..... F02B 75/20

[52] U.S. Cl. ..... 123/59 AC; 123/65 VA; 123/663

[58] Field of Search ..... 123/663, 188 C, 65 VA, 123/59 AC

[56] References Cited

U.S. PATENT DOCUMENTS 1,899,217 2/1933 Taylor et al. ..... 123/65 VA
2,132,802 10/1938 Pierce ..... 123/663
2,814,282 11/1957 Gross ..... 123/188 C
2,918,045 12/1959 Brown ..... 123/663
4,218,994 8/1980 Reed ..... 123/65 VA

*Primary Examiner*—David A. Okonsky
*Attorney, Agent, or Firm*—Harrison & Egbert

[57] ABSTRACT

Two stroke cycle internal combustion engine comprising; a ported cylinder, a cylinder head with an opening, a piston with an opening, a ported sleeve which is axially displaced inside the cylinder, extending through the cylinder head opening and the piston opening to form an annular combustion chamber. The position of the port in the sleeve is adjustable, longitudinally and latitudinally to control port timing, duration and the direction of the gasses flow inside the combustion chamber.

9 Claims, 1 Drawing Sheet

TWO STROKE CYCLE INTERNAL COMBUSTION ENGINE

BACKGROUND OF THE INVENTION

1. Field of the Invention

The present invention relates to an internal combustion engine. More specifically, the present invention relates to a two cycle internal combustion engine providing a central supply sleeve inside the cylinder.

2. Prior Art

The today's two cycle internal combustion engine has several drawbacks compared with the four cycle internal combustion engine. Those drawbacks are: poorer volumetric efficiency resulting from a brief intake duration; excessive unburned fuel in the exhaust resulting from a short circuit between the intake and the exhaust ports; a higher combustion chamber temperature resulting from a combustion on each crank shaft rotation, which results in a lower compression ratio to avoid engine knocking.

This invention is to improve those drawbacks stated above.

SUMMARY OF THE INVENTION

The principal object of this invention is to provide a cylinder; a cylinder head with an opening; a piston with an opening; and a sleeve which is axially displaced inside the cylinder, extending through the cylinder head opening and the piston opening. This forms an annular combustion chamber. The cylinder has the intake and exhaust ports into its lower portion of the wall, and the sleeve also has an intake port into its lower portion of the wall to cooperate intake motion with each other. The sleeve also serves to house the fuel injection nozzle.

It also is an object of this invention is to provide the ports in the sleeve so that it can be used as an added intake port area and a exclusive fuel/air mixture supplier, while the other intake ports in the cylinder wall supplies pure air inside the cylinder. The position of the port in the sleeve, relative to the cylinder, can be changed to control port operation, such as timing, duration and the amount of gas flowing inside the cylinder. It can also cut off any supply from the sleeve to the inside of the cylinder. These adjustments are performed by the positioning of the sleeve, longitudinally and latitudinally. These adjustment make it possible to regulate the ideal amount of gas flow inside the cylinder in response to the various fresh charge supplies demanded during any range of the engine's operation.

Due to having a sleeve inside the combustion chamber, another object of this invention is performed by creating a cooler, uniformly heat distributed combustion chamber. Under these conditions the creation of excessive heat spots inside the combustion chamber are prevented, thereby allowing the engine to provide a higher compression ratio.

When applying the crankcase compression scavenging, another object of this invention is to provide an automatic sleeve positioner which is synchronized with the engine's various output operations. This becomes possible by utilizing the crankcase pressure which works to push the sleeve upward. Therefore, the higher the crankcase pressure, the higher the sleeve positions itself, and thus higher the engine's output. A more advanced port timing and a longer port opening duration are obtained.

A further object of this invention is to provide two different functional intake ports. One intake port supplies fuel/air mixture and the other intake port supplies pure air the combustion chamber. The fuel/air mixture intake port has its own pressurized air supply source and the fuel injection nozzle in front of the port. The fuel injection timing is set so that the fuel will not escape from the exhaust port.

One point which needs to be taken into consideration, however, is that this engine needs longer connecting rods or the use of an oval cylinder to provide the sufficient clearance of the rotating crankshaft.

BRIEF DESCRIPTION OF THE DRAWINGS

The FIGS. 1 and 2, are cross-sectional views, in side elevation, of this invention showing the piston at its lowermost position.

DETAILED DESCRIPTION OF THE INVENTION

Figure 1:
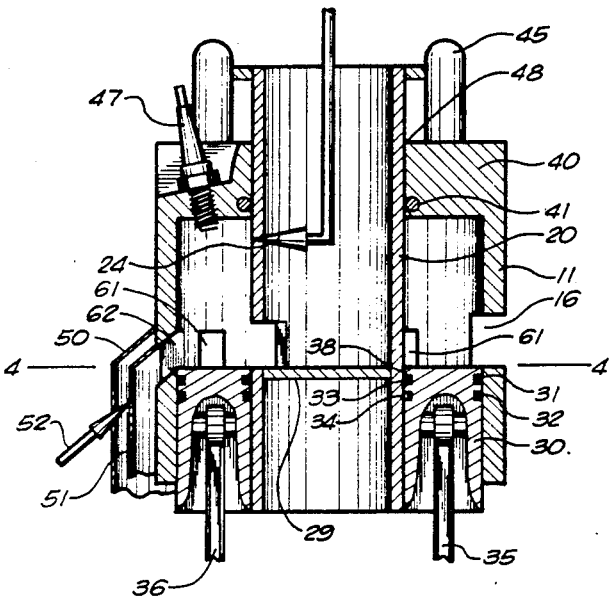
FIG. 1 particularly shows the sleeve at its topmost position for the engine's maximum output operation. In addition, the intake manifold is attached to the engine in this figure.

On referring to the drawings it will been seen that a cylinder 11 with a head 40 are provided, in which is axially disposed a sleeve 20 and an annular piston 30. The annular piston 30 is slidably held between the inner wall of the cylinder 11 and the outer wall of the sleeve 20, thereby forming annular combustion chamber 14. The piston 30 provides the outer piston rings 31, 32 and the inner piston rings 33, 34 and the connecting rods 35, 36.

The cylinder head 40 has an opening 48 which hold the sleeve slidably and sealinqly with the help of the O-ring 41.

The cylinder 11 provides the exhaust port 16 and the intake port 61, 62 into its lower portion of the wall. The port 61 supply air and the port 62 supplies fuel/air mixture into the cylinder. The port 61 is connected to the intake manifold 50 and the port 62 is connected to the separate pressurized air conduit 51 and provides fuel injection nozzle in front of the port. The fuel injection timing is set to minimize the time allowed for the fuel to escape from the exhaust port 16 while maximizing the time for fuel atomization.

The sleeve 20 is cylindrical and its upper portion is sealingly held by the cylinder head opening 48, and the other side is slidably held by the opening of the piston 39. The sleeve has an intake port 22 into its lower portion of the wall, the length (distance from bottom edge to top edge) of the port 22 is longer than that of the intake port 61. The fuel injection nozzle 24 is provided inside the sleeve 20.

The position of the port 22, relative to the cylinder 11, is adjustable by the sleeve position adjuster 45. The adjuster 45 controls sleeve position longitudinally (up and down and latitudinally (left and right). This controls the port 22 intake timing, duration and the amount and the direction of the gas flow into the combustion chamber obtaining ideal scavenging process on any range of the engine's operation.

This adjustment is useful when the port 22 is supplying fuel/air mixture inside the cylinder, while the other intake ports in the cylinder is supplying pure air inside the cylinder. The adjustment can be set so that the fuel will not escape from the exhaust port 16. This adjustment can be done by computer-controlled mechanical or electrical means.

This adjustment can also be done automatically when applying crankcase compression scavenging, utilizing the crankcase pressure which works to push the sleeve upward. In this case, adjuster 45 can be just a simple apparatus such as one which is merely spring assisted with delayed release hold down device. With this hold down device, the sleeve 20 synchronizes its position with the variation of the crankcase pressure which corresponds to the engine's various outputs. Thus the higher the engine's output, the higher the sleeve position which allows the port 22 to obtain advanced and long duration intake timing. This condition is useful when the port 22 is supplying pure air while the other intake ports in the cylinder supply a fuel/air mixture inside the combustion chamber.

On the drawings, a disk 29 is sealingly displaced inside the sleeve, below the intake port 22 to receive a fresh charge from the top opening of the sleeve 20. But the sleeve can receive a fresh charge from the bottom opening or from the both openings also.

The sleeve 20 may be integrated with the cylinder head 40 when the sleeve adjustment deem it not to be necessary for the engine's construction.

Figure 4:
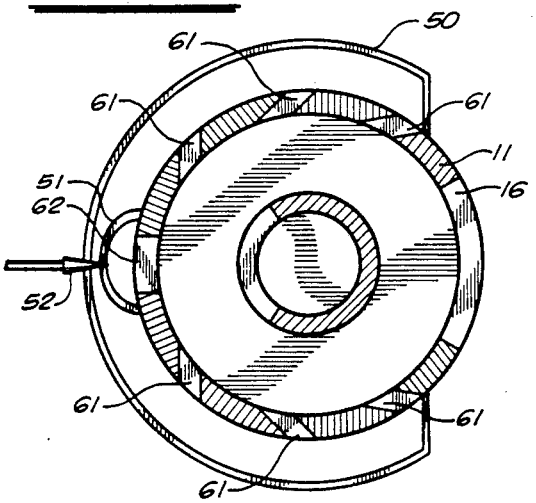
FIG. 4 is a plane view of the section 4—4 of FIG. 1.

FIG. 4 shows the arrangement of one of the ports in detail. The intake port 61 in the cylinder wall and the intake port 22 in the sleeve supply gasses toward opposite sides of the exhaust port 16. The gasses collide with each other to first turn the flow upward and then downward to opposite sides to push the burnt gasses from the exhaust port 16. The intake port 61 has a intake manifold 50 for the pure air supply, intake port 62 has an air conduit 51 and a fuel injection nozzle 52, to provide a rich fuel/air mixture inside the combustion chamber 14.

The intake port 22 in the sleeve supplies either a pure air or the fuel/air mixture whichever is favourable to the various outputs of the engine.

Other possible port arrangements, not shown in the drawings, are described below:

The sleeve has an intake port into its lower portion of the wall and the cylinder has an exhaust port into its lower portion of the wall.

The cylinder has an intake and an exhaust port into its lower portion of the wall while the sleeve provides no port.

Figure 2:
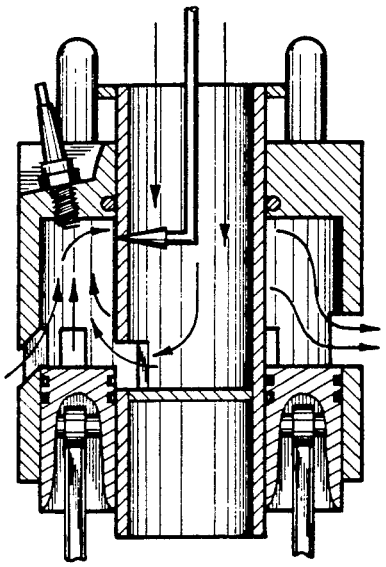
FIG. 2 particularly shows the flow of gas in and out of the cylinder. The sleeve is positioned at its middle position.
Figure 3:
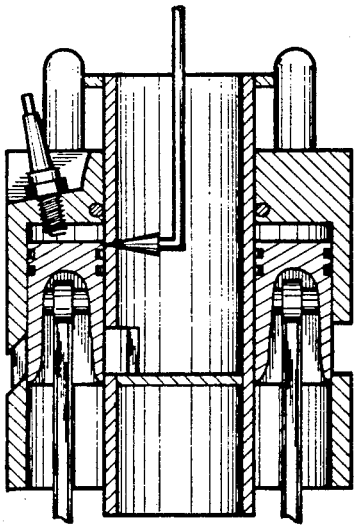
FIG. 3 shows a cross-sectional view, in side elevation, of this invention showing the piston at its topmost position. All ports are concealed by the piston.

In the operation, as the piston 30 approaches its lowermost position as shown on FIGS. 1 and 2, first, the exhaust port 16 is open to blow-down the burnt gasses. As the pressure inside the combustion chamber 14 goes down below the intake gas pressure, then the intake port 22 and 61 are open to start supplying a pure air into the combustion chamber 14. And then the intake port 62 is open to start supplying rich fuel/air mixture inside the cylinder. This rich fuel/air mixture is diluted by the air from the intake port 22 and 61 to make lean fuel/air mixture.

During the engine's higher output, operation timing for the port 22 is advanced and prolonged to respond engine's higher fresh charge demand.

As the piston moves upward, intake and then exhaust ports are closed to seal the combustion chamber 14, then the fuel injection nozzle 24 in the sleeve starts injecting the fuel inside the cylinder to make rich fuel/air mixture around the spark plug 47. As the piston approaches its topmost position, spark plug 47 ignites the compressed fuel/air mixture to complete the engine's operation.

I claim:

1. Two cycle internal combustion engine comprising: a cylinder, a cylinder head with an opening, a piston with an opening, and a sleeve which is axially displaced inside the cylinder extending through the cylinder head opening and the piston opening; said piston being slidably held between the inner wall of the cylinder and the outer wall of the sleeve to form an annular combustion chamber.

2. The two cycle engine of claim 1 wherein the cylinder has at least one intake port and at least one exhaust port.

3. The two cycle engine of claim 1 wherein the cylinder has at least one exhaust port and the sleeve has at least one intake port.

4. The two cycle engine of claim 1 wherein the cylinder has at least one intake port and at least one exhaust port and the sleeve has at least one intake port.

5. The two cycle engine of claim 1 wherein said sleeve has at least one intake port, the position of the port in the sleeve, relative to the cylinder, is adjustable by longitudinal movement of the sleeve.

6. The two cycle engine of claim 1 wherein the position of the sleeve is automatically adjustable.

7. The two cycle engine of claim 1 wherein said sleeve has at least one intake port, the vertical length of the port in the sleeve is longer than the vertical length of an intake port in the cylinder.

8. The two cycle engine of claim 1 wherein the sleeve has at least one fuel injection nozzle in it.

9. The two cycle engine of claim 1 wherein said cylinder wall has at least one intake port having at least one fuel injection nozzle directing fuel through the port.

* * * * *